US007471258B2

(12) United States Patent
Hsu et al.

(10) Patent No.: US 7,471,258 B2
(45) Date of Patent: Dec. 30, 2008

(54) COAXIAL CABLE HAVING HIGH RADIATION EFFICIENCY

(75) Inventors: Tsung-Yuan Hsu, Westlake Village, CA (US); Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 259 days.

(21) Appl. No.: 11/412,575

(22) Filed: Apr. 26, 2006

(65) Prior Publication Data

US 2007/0252777 A1 Nov. 1, 2007

(51) Int. Cl.
*H01Q 1/36* (2006.01)

(52) U.S. Cl. ..... 343/895; 343/798; 174/109

(58) Field of Classification Search ..... 343/895, 343/798; 174/109, 108

See application file for complete search history.

(56) References Cited

U.S. PATENT DOCUMENTS

| | | | | |
|---|---|---|---|---|
| 3,417,400 | A | | 12/1968 | Black |
| 4,129,841 | A | | 12/1978 | Hildebrand et al. |
| 4,152,648 | A | * | 5/1979 | Delogne ..... 455/523 |
| 4,339,733 | A | | 7/1982 | Smith |
| 4,987,394 | A | * | 1/1991 | Harman et al. ..... 333/237 |
| 5,936,203 | A | | 8/1999 | Ryman |

OTHER PUBLICATIONS

Wait, J.R., "Electromagnetic Theory of the Loosely Braided Coaxial Cable: Part 1," IEEE Transactions on Microwave Theory and Techniques, vol. MIT-24, No. 9 (Sep. 1976).

Adams, R.C., et al., "COMWIN Antenna System Fiscal Year 200 Report," SPAWAR, Technical Report 1836, (Sep. 2000).

* cited by examiner

*Primary Examiner*—Tho G Phan

(57) ABSTRACT

A radiating coaxial cable transmission line that may be used as an antenna. Mechanisms are incorporated for boosting the rate of conversion of bifilar mode to monofilar mode.

29 Claims, 8 Drawing Sheets

COAXIAL CABLE HAVING HIGH RADIATION EFFICIENCY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO AN APPENDIX

Not applicable.

FIELD

The technology described herein is generally related to the field of coaxial cables, more specifically to radiating coaxial cable transmission lines, and particularly to types used as antennas.

BACKGROUND

It is known to use a radiating coaxial cable transmission line, also commonly referred to as a "leaky wave coaxial cable" or simply a "leaky cable," as an antenna. Long line leaky cable antennas are useful for communication applications where a point source antenna is inadequate—e.g., in tunnels, mines, along roadways, or the like. Standard coaxial cables are modified to have slots, loose braids, or helical shields designed so that communication signals leak out over long distances, e.g., several miles or kilometers. Fundamentals of known manner radiating coaxial cable technology are described in U.S. Pat. No. 3,417,400 (Black, December 1968), incorporated herein by reference. Basics of apertured radiating coaxial cables are described in U.S. Pat. No. 4,339,733 (Jul. 13, 1982) to Smith for a Radiating Cable, incorporated herein by reference. Radiating Cables Having Spaced Radiating Sleeves are described by Hildebrand, et al. in U.S. Pat. No. 4,129,841, incorporated herein by reference.

The electromagnetic radiation (EM) modes that a leaky cable antenna supports are shown in FIG. 1 (Prior Art). The term "electromagnetic waveband" is used herein for any audio, visual, microwave, computer broadband, and the like communications signals extant in the state-of-the art. A leaky cable is generally a two-wire transmission line that may support two modes: a bifilar mode and a monofilar mode. Referring now to FIG. 1 section (a), a leaky cable 101*a* is constructed much like an ordinary solid coaxial cable having a center conductor 102, but modified with a spiral, helical, outer conductor 106. The outer conductor 106 is wound with a substantially constant pitch as it traverses around the outer surface of and down the longitudinal axis of an inner dielectric insulator 104 surrounding the center conductor 102. The cable 101*a* similarly includes an outer insulator 108. EM fields (represented by radiating arrows) with respect to cable 101*a* are largely concentrated between the two conductors, known as the bifilar mode. That is the EM fields generally non-radiative with respect to the local environment. Looking now to FIG. 1 section (b), a cable 101*b* in the monofilar mode is similar to that of a single-wire transmission line with a dielectric coating. It is radiative at discontinuities in the construct. The EM fields with respect to cable 101*b* are largely concentrated in the air region around the cable. There is no return conductor in this device; the return path may be considered to be a notional ground plane that is an infinite distance from the cable 101*b*. It is known that if two counter-wound helical outer conductors have exactly the same pitch, such a cable performs similarly to ordinary single helical coaxial cable. See e.g., *Electromagnetic Theory of the Loosely Braided Coaxial Cable: Part I*, Wait, J. R., IEEE Transactions on Microwave Theory and Techniques, Vol. MIT-24, No. 9, September 1976, incorporated herein by reference.

On a perfectly uniform cable, neither of these two modes radiate a substantial EM field since their phase velocity is slower than the speed of light. The phase velocity of the bifilar mode is governed by the inner dielectric insulator. However, the phase velocity of the monofilar mode is just slightly slower than the speed of light, which means that it is only loosely bound to the cable, and extends a significant distance into free space. In this mode EM radiation is easily scattered by discontinuities or bends in the cable. Thus, traditional helical wound leaky cable antennas work over long distances because of the constant flow of energy between these two weakly coupled modes, with the monofilar mode gradually leaking power into the surrounding space. As a result, conventional leaky cable antennas typically require hundreds of wavelengths or more to radiate efficiently, making them suitable for use as multiband antennas inside tunnels, mines, along roadways or the like.

Such leaky cable antennas provide additional environmental robustness compared to a single point radiator type (such as a bow-tie antenna) in that if a portion of the cable is shorted out, such as by moisture or nearby conductive surfaces, the energy simply continues down the cable and radiates from the next available radiator region.

There have been developed specifications for military antenna systems—such as that described by R. C. Adams, R. S. Abramo, J. L. Parra, J. F. Moore, "COMWIN Antenna System Fiscal Year 200 Report," SPAWAR, San Diego, Calif., Technical Report 1836, September 2000—where leaky cable antennas have been employed but are usually designed for broadband application. Use in proximity to military personnel has raised series radiation hazard issues. Prototypes described therein also exhibit signal distribution patterns sometimes having one or more null regions, thus exhibiting a relatively lesser operational efficiency. Another problem is that military specifications define specific signal polarizations for particular applications. Thus, field antenna systems must perform accordingly depending upon the transmission source protocols in use during current operations.

Another adaptation for using a leaky cable antenna is for covert operations—such as for investigative or military applications—where it is desirable to mask the visual signature of the user of antenna-related communication devices. It has been found that a wearable antenna is advantageous. However, for such applications, problems related to signal transmission—e.g., bandwidth and directionality capabilities, field effects due to proximity of a human body, and the like—and to wearability—e.g., disguisability, weight and flexibility, robustness, radiation hazards protection, and the like—must be accounted for in the design.

There is a need for leaky cable antenna devices and methods which address the foregoing issues.

SUMMARY

The present invention generally provides for high efficiency leaky cable antennas. Exemplary embodiments include features providing highly efficient mechanisms for increasing, boosting, the rate of conversion between bifilar and monofilar modes.

In accordance with one aspect of the present invention, there is provided a radiating coaxial cable transmission line apparatus having high radiation efficiency, the apparatus including: at least one center conducting mechanism for carrying electromagnetic waveband signals; surrounding said center conducting mechanism, at least one first dielectric mechanism for electrically insulating said center conducting mechanism; superjacent said first dielectric mechanism, at least one mechanism for boosting bifilar-to-monofilar mode rate conversion of said signals; and surrounding said mechanism for boosting bifilar-to-monofilar mode rate conversion, said first dielectric mechanism, and said center conducting mechanism, at least one second dielectric mechanism for insulating said apparatus from a local environment.

Another aspect of the present invention may be described as a method of fabricating a radiating coaxial cable transmission line device, the method including: extending a first length of a center conductor for carrying electromagnetic waveband signals; surrounding said center conductor with first dielectric material for electrically insulating said center conductor; wrapping superjacent to said first dielectric material at least one conductor for boosting bifilar-to-monofilar mode rate conversion of said signals; and surrounding said at least one conductor for boosting bifilar-to-monofilar mode rate conversion, said first dielectric means, and said center conductor with second dielectric material for insulating said device from a local environment.

Another aspect of the present invention may be described as a user-wearable leaky cable antenna including: a flexible center conductor for carrying electromagnetic waveband signals; a substantially cylindrical, flexible, inner insulator surrounding said center conductor; at least one helical winding conductor wound around said inner insulator wherein said at least one helical winding conductor includes features for boosting bifilar-to-monofilar mode rate conversion of said signals; and a substantially cylindrical outer insulator surrounding said second helical winding conductor, said first helical winding conductor, said inner insulator, and said center conductor.

Some objects and advantages of the present invention are:

to improve the state of the art of radiating coaxial cable transmission lines, particularly for wearable antenna embodiments;

it is an advantage that it operates over a very broad bandwidth, obtaining reasonable performance over several octaves of EM waveband bandwidth and is particularly efficient in the approximate range of UHF to S-band;

it is another advantage that it is omnidirectional, it is another advantage that it supports both horizontal and vertical signal polarizations, simulating a large distributed radiating structure regardless of position or orientation;

it is another advantage that it provides a flexible device that can be easily integrated into clothing, body armor, vests, backpacks, or like wearable gear;

it is another advantage that it may be implemented in a relatively short size compared to a human body and thus not adding significant weight, volume, or rigidity to the wearable gear;

it is another advantage that it can be routed in wearable gear in a variety of positions without significantly affecting the overall performance;

it is another advantage that it distributes emitted power over a large area of the proximate body, having lower specific absorption rate (SAR) compared to single point radiators.

The foregoing summary is not intended to be inclusive of all aspects, objects, advantages and features of the present invention nor should any limitation on the scope of the invention be implied therefrom. This Brief Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches.

BRIEF DESCRIPTION OF THE DRAWINGS

FIG. 3 is a set of graphs showing linear average gain in both signal polarizations as a function of frequency, where

FIGS. 5A and 5B present a schematic depiction of prototype exemplary embodiments in accordance with the present invention in which FIG. 5A is a first embodiment and FIG. 5B is a second embodiment.

Like reference designations represent like features throughout the drawings. The drawings in this specification should be understood as not being drawn to scale unless specifically annotated as such.

DETAILED DESCRIPTION

The present invention discloses mechanisms for significantly boosting the rate of conversion between bifilar and monofilar modes in radiating coaxial cable transmission lines. In an implementation as a leaky cable antenna, the present invention has been found to be highly efficient when compared to known manner leaky cable antennas. The mode conversion is a factor which may be measured in coupling/meter for EM waveband signal coupling attenuation rate or growth rate.

Figure 1:
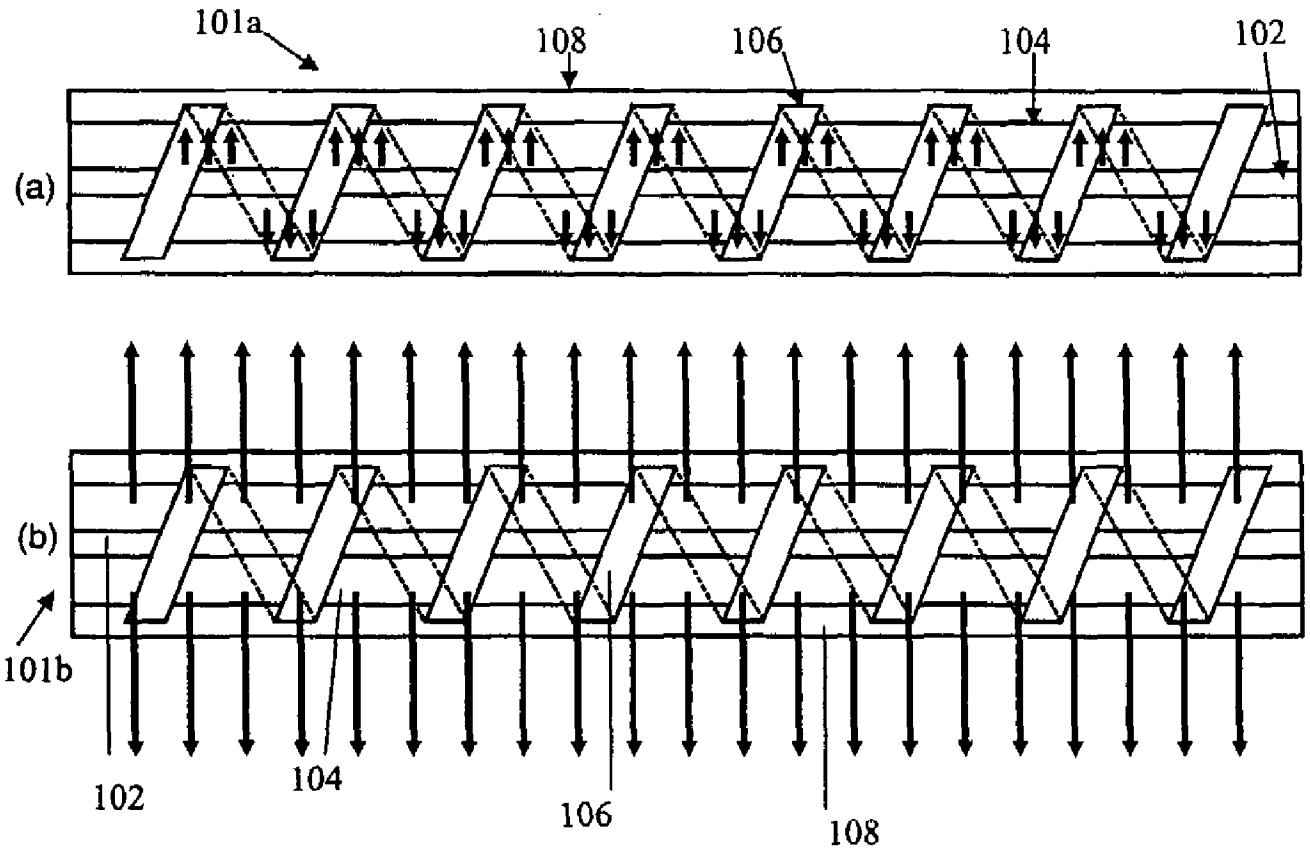
FIG. 1 (Prior Art)
FIG. 1 (Prior Art) shows a helical-wound coaxial cable in which section (a) demonstrates an EM field of the bifilar mode and section (b) demonstrates an EM field of the monofilar mode.
Figure 2:
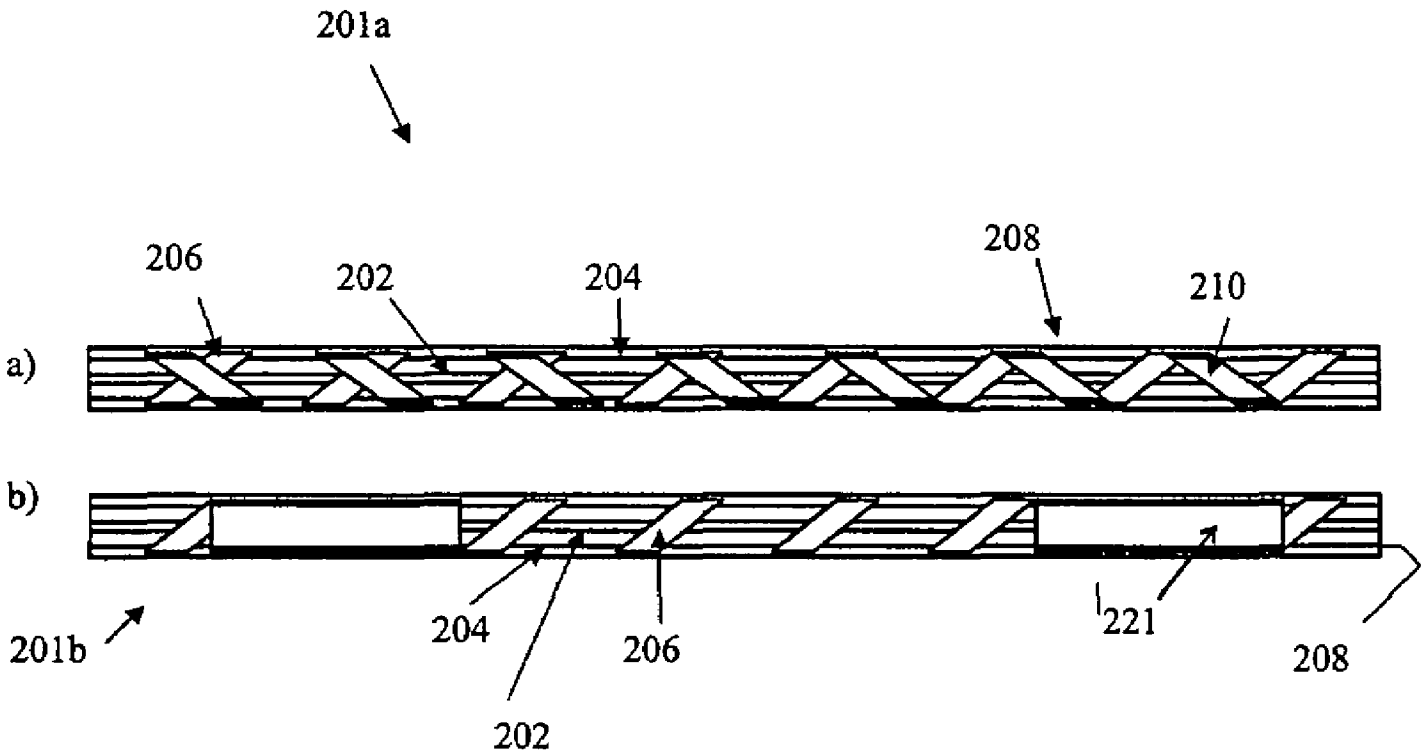
FIG. 2 depicts schematic cross-sections of a coaxial cable in accordance with exemplary embodiments of the present invention in which section a) is a first exemplary embodiment and section b) is a second exemplary embodiment.

FIG. 2 shows two exemplary embodiments of mode conversion structures in longitudinal section elevation views. Beginning with FIG. 2 section a), there is shown a first exemplary embodiment of a leaky cable antenna 201*a* in accordance with the present invention.

The antenna 201*a* structure includes a center conductor 202, an inner insulator 204, a helical wound outer conductor 206, and an outer-insulator 208, all generally fabricated in a known manner. Conductive and dielectric materials may be used in accordance with the extant state-of-the-art. In accordance with one exemplary embodiment of the present invention, the antenna 201*a* structure includes a second helical conductor 210 that may be wound in the direction opposite to the first 206. It has been found in accordance with the present invention that if the two counter-wound helical outer conductors 206, 210 have different pitches to their respective winding, the EM waves are scattered in accordance with a spatial beat frequency between the two helicals. It has been found that this results in more rapid mode conversion and more efficient radiation than in known manner leaky cable antennas.

Note that while contra-wound helices are demonstrated, other implementations may be considered within the scope of the present invention. Furthermore, there may be more than two windings.

In manufacturing a particular implementation, the baseline for a basic design of relative pitch for the at least two windings may begin with the equation:

$$1/p_1-1/p_2=1/\lambda \quad \text{(Equation 1)},$$

where:

$p_1$ is the pitch angle for the first winding, $p_2$ is the pitch angle for the second winding, and $\lambda$, is the approximate center wavelength for the bandwidth-of-interest.

It has been found that the present invention may be implemented with a ratio of relative pitch angle ratios from 1/1 to 2/1, excluding the self-defining extremes thereof which would merely create overlapped windings. It should be noted that the mode conversion factor thus may be tuned by design for specific implementations for specific ranges of transmission frequency.

Figure 3A:
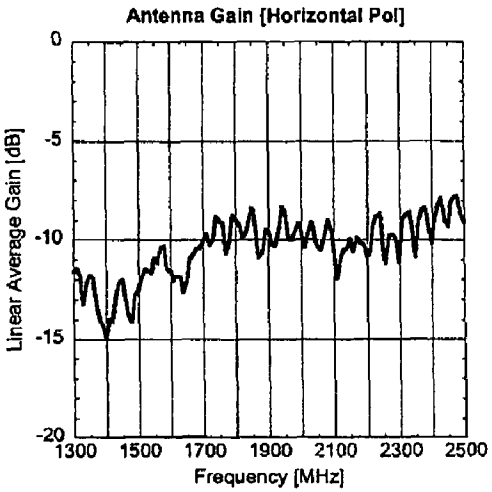
FIG. 3A is for horizontally polarized frequencies and FIG. 3B is for vertically polarized frequencies.
Figure 3B:
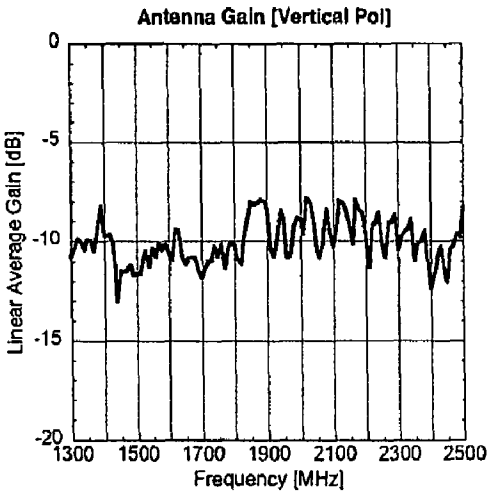
Figure 4A:
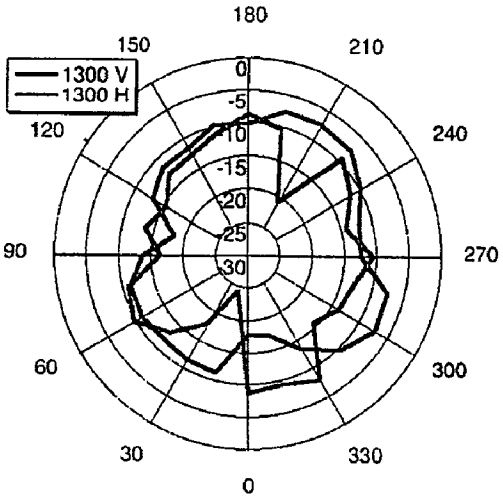
FIGS. 4A-4E are a set of plots of the radiation patterns at different frequencies throughout bands-of-interest for an exemplary embodiment implementation of the present invention.
Figure 4B:
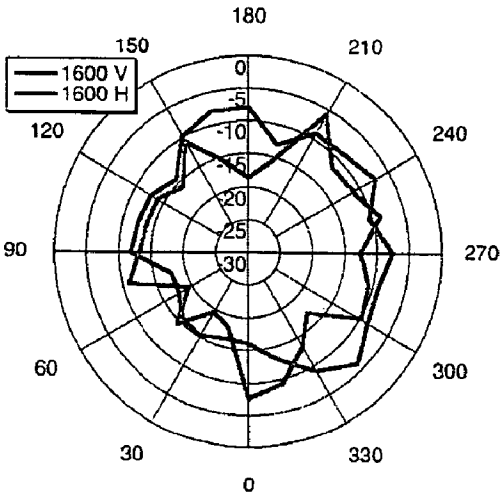
Figure 4C:
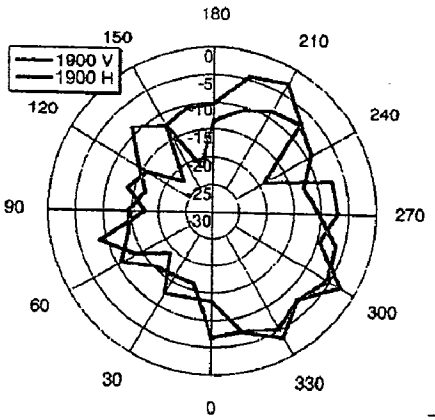
Figure 4D:
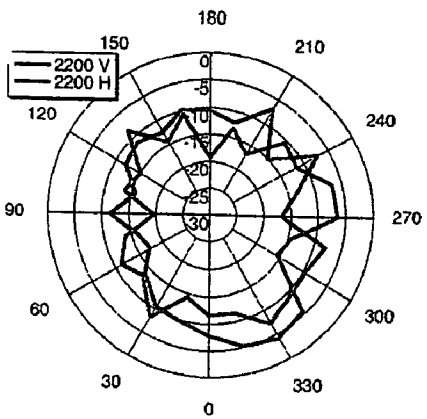
Figure 4E:
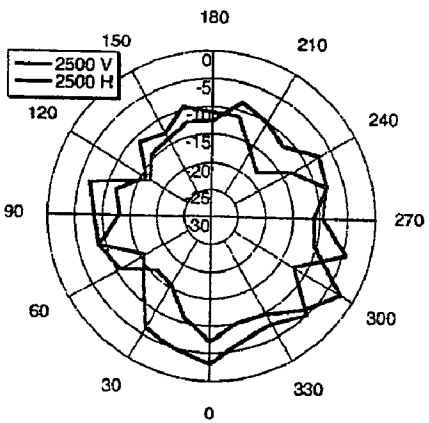
Figure 5A:
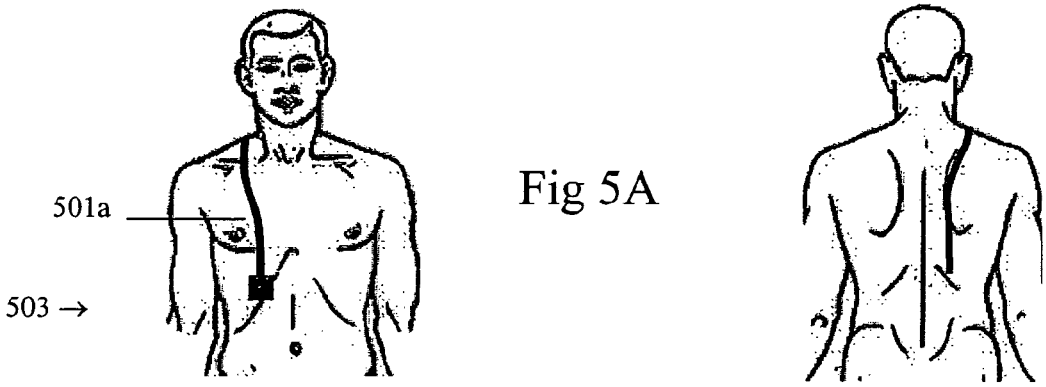
Figure 5B:
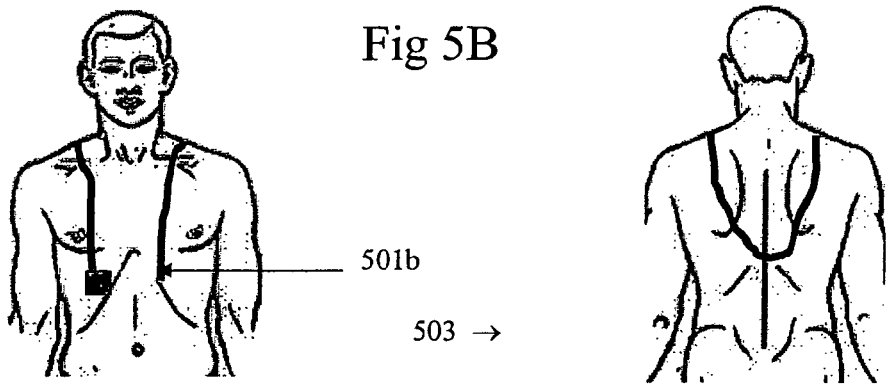

FIGS. 5A and 5B depict two prototype exemplary embodiments for leaky cable antennas 501*a*, 501*b* in accordance with the present invention as may be incorporated into wearable gear (not shown) and placed on a human body, or for test purposes a human body simulator, 503. The length of the prototype antenna 501*a* was approximately one-half meter and the length of the prototype antenna 501*b* was approximately one meter. The antennas 501*a*, 501*b* have random vertical (V) and horizontal (H) polarization capability. Data was measured over a wide range of frequencies. For the prototype 501*b*, FIG. 3 plots linear average gain in both polarizations as a function of frequency, where FIG. 3A is for horizontally polarized radio frequencies and FIG. 3B is for vertically polarized radio frequencies. The antenna 501*b* produced an average gain of about −10 dBi in both polarizations over the band-of-interest. In other words, energy was radiated substantially equally for either polarization. The expected gain, G, of this antenna can be summarized by the following equation:

$$G=G_{ISOTROPIC}-L_{RETURN}-L_{POLRIZATION}-L_{ABSORPTION} \quad \text{(Equation 2)},$$

where:

$G_{ISOTROPIC}$ is the gain of an isotropic radiator, or 0 dBi, $L_{RETURN}$ is the return loss, related to the feed mismatch, which is about 2 dB in the shown prototype 501*b*, $L_{POLRIZATION}$ is equal to 3 dB for an antenna having random polarization, and $L_{ABSORPTION}$ is the power absorbed into the human body simulator 503, often about 3 dB.

This prototype antenna 501*b* was expected, in accordance with Equation 2, to have gain calculated as: G=0 dB−2 dB−3 dB−3 dB=−8 dBi. The measured gain value of this prototype 501*b* was −10 dBi. The additional −2 dB may be due to extra losses in the human body model 503—which may be minimized by proper placement and shielding such as described with respect to FIG. 6 hereinafter—or due to absorption in the antenna itself—which can be minimized by proper design and choice of materials in accordance with the extant state of the art. While the graphs show data for a frequency range of 1300 MHz-2500 MHz, it is not intended to be, nor should it be interpreted to be, a limitation on the scope of the invention; it has been found that the present invention may be implemented for most EM waveband frequencies and is particularly efficient in those ranging from a few hundred megahertz to a few gigahertz.

The prototype leaky cable antennas 501*a*, 501*b* draped around the human body simulator 503 as shown in FIGS. 5A and 5B provide coverage from substantially every angle. By routing the leaky cable antenna over a relatively large are of the body, such as by incorporating it into a wearable torso garment, radiation patterns are typically broad, without deep nulls or broad shadowed regions. FIGS. 4A-4E show several plots of the radiation patterns at different frequencies throughout the band-of-interest for the prototype antenna 501*b*. The average gain is −10 dBi. The radiation patterns are relatively uniform, and any nulls tend to be shallow. The average difference between the lowest and highest gain was about 17 dB, and individual nulls rarely drop lower than −25 dBi. In general, the testing results showed that a gain of greater than −6 dBi over the entire band-of-interest is feasible. Maximizing the uniformity of the radiation pattern for practical implementations are therefore feasible based on these concepts in accordance with the present invention. Thus, the present invention provides an omnidirectional antenna, substantially impervious in a wearable implementation to the position or orientation of the wearer.

Returning to FIG. 2 section b), a second exemplary embodiment is shown for implementing the method for increasing the radiation efficiency by increasing the rate of conversion between bifilar and monofilar modes in accordance with the present invention. Periodically incorporated conductive sleeves, sometimes referred to in the art as conductive bands or conductive rings, 221 are included within the outer insulator 108 along the length of a leaky cable antenna 201*b*. Like the double helical winding embodiment of FIG. 2 section a), these sleeves 221 tend to scatter energy between the two modes and increase their rate of conversion coupling, thus increasing the radiation efficiency for a short length, leaky cable antenna 201*b*. The conductive sleeves 221 are implemented as sleeves individually inserted in a spaced distribution along the longitudinal axis extension of the leaky cable antenna 201*b*. Specific configuration is dependent upon the dimensions for a particular implementation and the bandwidth of energy to be radiated and transmitted. In general, it has been found that mode conversion efficiency is increased when the spacing is less than or equal to one-half the center wavelength-of-interest and the size of each sleeve is substantially less than one-half the center wavelength-of-interest. It is worth noting that this implementation is generally contrary to the convention art such as demonstrated by Hildebrand, et al., supra.

Figure 6:
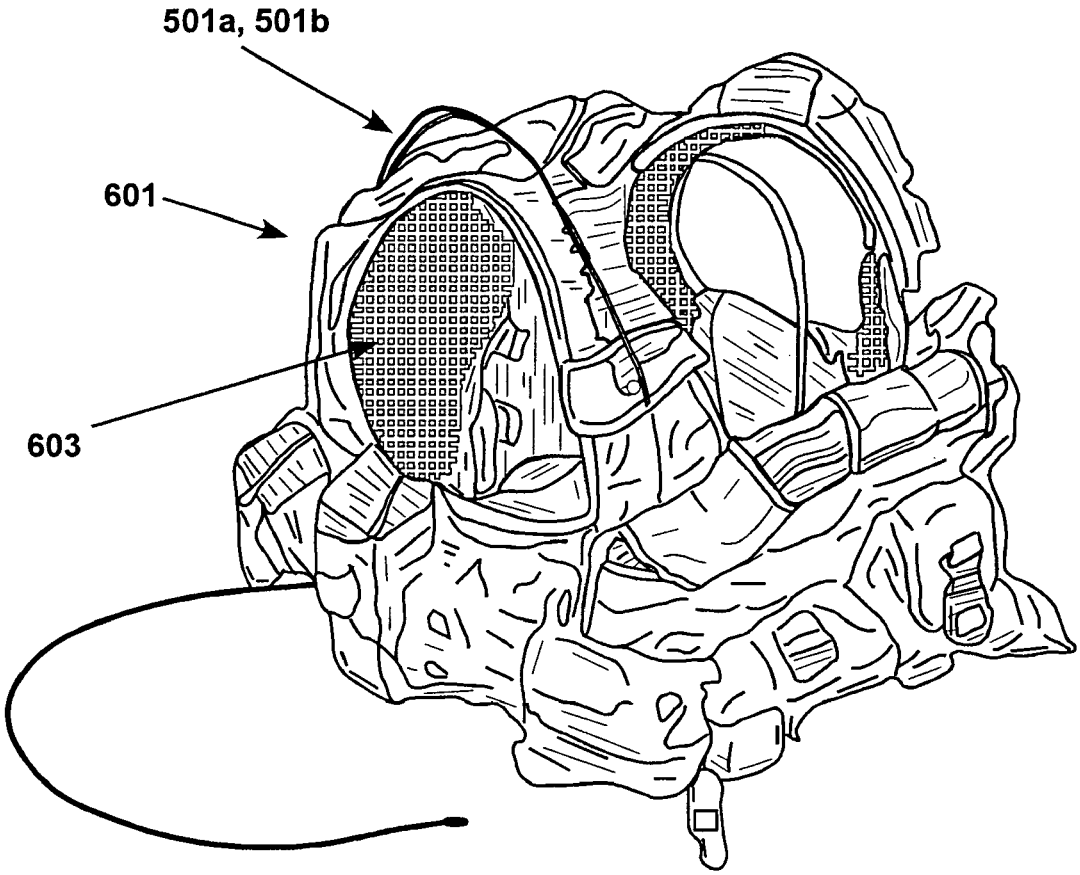
FIG. 6 depicts an exemplary form of wearable gear implemented in accordance with the present invention.

An important feature of the invention in accordance with such an implementation is a relatively low emission of radiation, particularly heat measured in watts/sq. cm., making the invention particularly suited for incorporation into wearable gear. FIG. 6 depicts an exemplary form of wearable gear 601 implemented in accordance with the present invention. It has been found that energy absorption into the human body is reduced by incorporating a conductive material mesh 603 between the antenna 501*a*, 501*b* and the human body (not shown). In this manner, the specific absorption rate characteristic of the antenna 501*a*, 501*b* may be further improved over known manner single point radiators and with respect to implementations of the embodiments as shown in FIG. 2. The gain and efficiency of the antenna 501*a*, 501*b* thus is increased.

Figure 7:
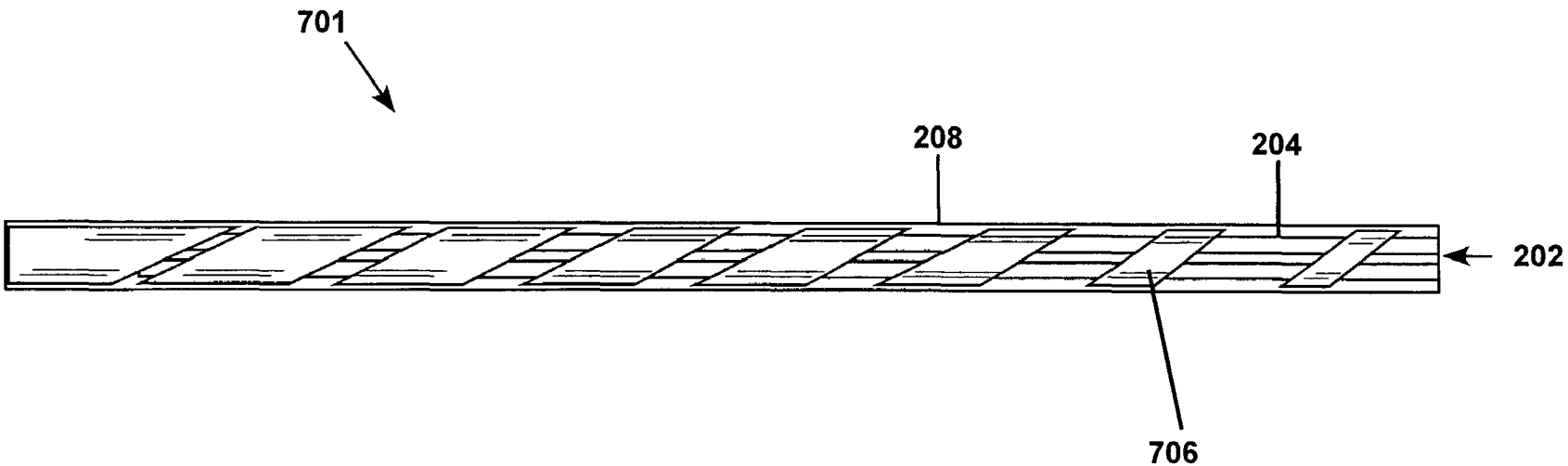
FIG. 7 is a schematic drawing of a cross-section of another exemplary embodiment of a coaxial cable in accordance with the present invention.

FIG. 7 shows another alternative embodiment of a leaky cable antenna 701 in accordance with the present invention. At least one winding 706 is cross-sectionally tapered over its length along the longitudinal axis of the antenna 701. It has been found that this may improve the feed mismatch characteristic over the embodiments as shown in FIG. 2 sections a) and b). Tapering at least one winding may be incorporated with the counter-wound helices embodiment of FIG. 2 section a) or with the spaced sleeves embodiment of FIG. 2 section b).

From the foregoing description, it will be apparent that the present invention has a number of advantages, some of which have been described above, and others of which are inherent in the embodiments of the invention described above. Also, it will be understood that modifications can be made to the invention described without departing from the teachings of subject matter described herein. As such, the invention is not to be limited to the described embodiments except as required by the appended claims.

The invention claimed is:

1. Radiating coaxial cable transmission line apparatus having high radiation efficiency, the apparatus comprising:

center conductor for carrying electromagnetic waveband signals;

surrounding said center conductor, a first insulator for electrically insulating said center conductor;

superjacent said first insulator means for boosting bifilar-to-monofilar mode rate conversion of said signals comprising a: first helical outer conductor wound with a first helical pitch around the first insulator and a second helical outer conductor wound with a second helical pitch around said first insulator and proximate said first helical outer conductor; and surrounding said means for boosting bifilar-to-monofilar mode rate conversion, said first insulator, and said center conductor, a second insulator for insulating said apparatus from a local environment, wherein said first helical pitch and said second helical pitch are determined by an equation comprising:

$$1/p_1-1/p_2=1/\lambda$$

where: $p_1$ is pitch angle for the first helical outer conductor, $p_2$ is pitch angle for the second helical outer conductor, and $\lambda$ is approximate center wavelength for a bandwidth-of-interest.

2. The apparatus as set forth in claim 1 wherein relationship of said second helical pitch to said first helical pitch is in an approximate range of 1/1 to 2/1, excluding self-defining extremes thereof.

3. The apparatus as set forth in claim 1 wherein said apparatus has a longitudinal length of approximately one meter or less.

4. Radiating coaxial cable transmission line apparatus having high radiation efficiency, the apparatus comprising:

a center conductor for carrying electromagnetic waveband signals;

surrounding said center conductor, a first insulator for electrically insulating said center conductor;

superjacent said first insulator for boosting bifilar-to-monofilar mode rate conversion of said signals; and surrounding said means for boosting bifilar-to-monofilar mode rate conversion, said first insulator, and said center conductor, a second insulator for insulating said apparatus from a local environment, said means for boosting bifilar-to-monofilar mode rate conversion of said signals including:

wound around said first insulator, a helical outer conductor for radiating said signals, and internally of said second insulator and serially spaced along a longitudinal axis of said apparatus and adjacent said helical outer conductor, a plurality of conductive sleeves for radiating said signals.

5. The apparatus as set forth in claim 4 wherein the conductive sleeves are spaced serially along said longitudinal axis by a distance equal to or greater than one-half an approximate center wavelength for bandwidth-of-interest.

6. The apparatus as set forth in claim 4 wherein each of the conductive sleeves has a longitudinal axis dimension greater than one-half an approximate center wavelength for bandwidth-of-interest.

7. The apparatus as set forth in claim 4 wherein said apparatus has a longitudinal length of approximately one meter or less.

8. Radiating coaxial cable transmission line apparatus having high radiation efficiency, the apparatus comprising:

center conductor for carrying electromagnetic waveband signals;

surrounding said center conductor, a first insulator for electrically insulating said center conductor;

superjacent said first insulator means for boosting bifilar-to-monofilar mode rate conversion of said signals; and surrounding said means for boosting bifilar-to-monofilar mode rate conversion, said first insulator dielectric means, and said center conductor, second insulator for insulating said apparatus from a local environment, said means for boosting bifilar-to-monofilar mode rate conversion comprising: wound around said first insulator along a longitudinal axis thereof, at least one helical outer conductor for radiating said signals wherein said at least one helical outer conductor has a taper along a substantially entire length thereof.

9. The apparatus as set forth in claim 8 wherein said apparatus has a longitudinal length of approximately one meter or less.

10. Radiating coaxial cable transmission line apparatus having high radiation efficiency, the apparatus comprising:

center conductor for carrying electromagnetic waveband signals;

surrounding said center conductor, a first insulator for electrically insulating said center conductor;

superjacent said first insulator, means for boosting bifilar-to-monofilar mode rate conversion of said signals; and surrounding said means for boosting bifilar-to-monofilar mode rate conversion, said first insulator, and said center conductor, second insulator for insulating said apparatus from a local environment, wherein said radiating coaxial cable transmission line apparatus is incorporated in wearable gear and wherein said wearable gear includes a mesh fabricated of a conductive material interposed between said antenna apparatus and a wearer of said wearable gear.

11. The apparatus as set forth in claim 10 wherein said radiating coaxial cable transmission line apparatus has a lower specific absorption rate factor compared to single point radiators for a signal bandwidth-of-interest.

12. A method of fabricating a radiating coaxial cable transmission line device, the method comprising: extending a first length of a center conductor for carrying electromagnetic waveband signals; surrounding said center conductor with first dielectric material for electrically insulating said center conductor; wrapping superjacent to said first dielectric material at least one conductor for boosting bifilar-to-monofilar mode rate conversion of said signals; and surrounding said at least one conductor for boosting bifilar-to-monofilar mode rate conversion, said first dielectric material, and said center conductor with second dielectric material for insulating said device from a local environment, wherein said at least one conductor for boosting bifilar-to-monofilar mode rate conversion includes a first helical winding for radiating said signals wherein said first helical winding is wound with a first helical pitch around first dielectric material, and a second helical winding for radiating said signals wherein said second helical winding is wound with a second helical pitch around said first dielectric material and is proximate said first helical winding and wherein said first helical pitch and said second helical pitch are determined by an equation comprising:

$$1/p_1-1/p_2=1/\lambda$$

where: $p_1$ is pitch angle for the first helical winding, $p_2$ is pitch angle for the second helical winding, and $\lambda$ is approximate center wavelength for bandwidth-of-interest.

13. The method as set forth in claim 12 wherein relationship of said second helical pitch to said first helical pitch is in an approximate range of 1/1 to 2/1, excluding self-defining extremes thereof.

14. A method of fabricating a radiating coaxial cable transmission line device, the method comprising: extending a first length of a center conductor for carrying electromagnetic waveband signals; surrounding said center conductor with first dielectric material for electrically insulating said center conductor; wrapping superjacent to said first dielectric material at least one conductor for boosting bifilar-to-monofilar mode rate conversion of said signals; and surrounding said at least one conductor for boosting bifilar-to-monofilar mode rate conversion, said first dielectric material, and said center conductor with second dielectric material for insulating said device from a local environment, wherein the conductor for boosting bifilar-to-monofilar mode rate conversion is a helical winding for radiating said signals wound around said first dielectric material, and mounted internally of said second dielectric material and serially spaced along a longitudinal axis of said apparatus and adjacent said helical winding is a plurality of conductive sleeves for radiating said signals.

15. The method as set forth in claim 14 wherein the conductive sleeves are spaced serially along said longitudinal axis by a distance equal to or greater than one-half an approximate center wavelength for bandwidth-of-interest.

16. The method as set forth in claim 14 wherein each of the conductive sleeves has a longitudinal axis dimension greater than one-half an approximate center wavelength for bandwidth-of-interest.

17. A method of fabricating a radiating coaxial cable transmission line device, the method comprising: extending a first length of a center conductor for carrying electromagnetic waveband signals; surrounding said center conductor with first dielectric material for electrically insulating said center conductor; wrapping superjacent to said first dielectric material at least one conductor for boosting bifilar-to-monofilar mode rate conversion of said signals; and surrounding said at least one conductor for boosting bifilar-to-monofilar mode rate conversion, said first dielectric material, and said center conductor with second dielectric material for insulating said device from a local environment, wherein the conductor for boosting bifilar-to-monofilar mode rate conversion is wound around said first dielectric material along a longitudinal axis thereof and includes at least one helical winding for radiating said signals wherein said at least one helical winding has a taper along its length.

18. A method of fabricating a radiating coaxial cable transmission line device, the method comprising: extending a first length of a center conductor for carrying electromagnetic waveband signals; surrounding said center conductor with first dielectric material for electrically insulating said center conductor; wrapping superjacent to said first dielectric material at least one conductor for boosting bifilar-to-monofilar mode rate conversion of said signals; and surrounding said at least one conductor for boosting bifilar-to-monofilar mode rate conversion, said first dielectric material, and said center conductor with second dielectric material for insulating said device from a local environment, further comprising: incorporating said device into wearable gear and incorporating into said wearable gear a mesh fabricated of a conductive material wherein said mesh is interposed between said device and a wearer of said wearable gear.

19. A user-wearable leaky cable antenna comprising: a flexible center conductor for carrying electromagnetic waveband signals; a substantially cylindrical, flexible, inner insulator surrounding said center conductor; at least one helical winding conductor wound around said inner insulator wherein said at least one helical winding conductor includes features for boosting bifilar-to-monofilar mode rate conversion of said signals; a substantially cylindrical outer insulator surrounding said at least one helical winding conductor, said inner insulator, and said center conductor; and a garment for integrally carrying said substantially cylindrical outer insulator surrounding said at least one helical winding conductor, said inner insulator, and said center conductor.

20. The antenna as set forth in claim 19 wherein said at least one helical winding conductor has a taper along a longitudinal axis of said antenna.

21. The antenna as set forth in claim 19, said at least one helical winding conductor comprising: a first helical winding having a first pitch, and a second helical winding having a second pitch.

22. The antenna as set forth in claim 21 wherein relationship of said second helical pitch to said first helical pitch is in an approximate range of 1/1 to 2/1, excluding self-defining extremes thereof.

23. The antenna as set forth in claim 21 wherein said first helical pitch and said second helical pitch are determined by an equation comprising:

$$1/p_1-1/p_2=1/\lambda$$

where: $p_1$ is pitch angle for the first helical winding, $p_2$ is pitch angle for the second helical winding, and $\lambda$ is approximate center wavelength for bandwidth-of-interest.

24. The antenna as set forth in claim 19 having a longitudinal length equal to or less than one meter and having a linear average gain in an approximate range of −15 dB to −8 dB over a frequency band range of approximately 1300 MHz to 2500 MHz, with horizontal polarization.

25. The antenna as set forth in claim 19 having a longitudinal length equal to or less than one meter and having a linear average gain in an approximate range of −13 dB to −8 dB over a frequency band range of approximately 1300 MHz to 2500 MHz, with vertical polarization.

26. The antenna as set forth in claim 19 wherein said device has a lower specific absorption rate compared to a single point radiator antenna for signals in a given frequency range.

27. The antenna as set forth in claim 19, said at least one helical winding comprising: a helical winding conductor wound around said inner insulator; and proximate said first helical winding and internally of said outer insulator, a plurality of longitudinal axis spaced conductive sleeves around said inner insulator.

28. The antenna as set forth in claim 27 wherein each of said conductive sleeves is spaced along a longitudinal axis of said antenna by a distance equal to or greater than one-half an approximate center wavelength for bandwidth-of-interest.

29. The antenna as set forth in claim 27 wherein each of the conductive sleeves has a longitudinal dimension greater than one-half an approximate center wavelength for bandwidth-of-interest.

* * * * *